United States Patent [19]

Jenkins

[11] 4,398,371

[45] Aug. 16, 1983

[54] MAGNETIC SMOKE AND FIRE SHIELD

[76] Inventor: James H. Jenkins, 6010 N. 26th St., Arlington, Va. 22207

[21] Appl. No.: 297,551

[22] Filed: Aug. 31, 1981

[51] Int. Cl.[3] ..... E05F 15/20

[52] U.S. Cl. ..... 49/7; 160/23 R; 160/1

[58] Field of Search ..... 49/7, 8, 478, 479, 485; 160/1, 354, 5, 6; 292/251.5

[56] References Cited

U.S. PATENT DOCUMENTS

| | | | |
|---|---|---|---|
| 445,372 | 1/1891 | Johns, Jr. | 160/1 |
| 949,482 | 2/1910 | Kabareck | 49/7 |
| 1,618,551 | 2/1927 | Perry et al. | 49/7 |
| 2,639,751 | 5/1953 | Flaherty | 160/354 |
| 3,451,706 | 6/1969 | Baermann | 292/251.5 |
| 3,597,809 | 8/1971 | Crane | 49/8 |
| 3,650,069 | 3/1972 | Alley | 49/7 |
| 3,756,137 | 9/1973 | Scharres | 160/1 |
| 3,777,422 | 12/1973 | Janssen | 49/8 |
| 3,950,894 | 4/1976 | DiMaio | 292/251.5 |
| 4,090,437 | 5/1978 | Bogaent | 49/8 |

*Primary Examiner*—Peter M. Caun

*Attorney, Agent, or Firm*—Laubscher, Philpitt & Laubscher

[57] ABSTRACT

A magnetic smoke and fire shield is disclosed for installation adjacent an air register associated with a building conduit to control the conduit opening. The apparatus includes a frame containing an opening, and a closure member connected with the frame for movement between open and closed positions relative to the frame opening. At least one of the closure members and frame is formed of ferromagnetic material, the other member having magnetic sealing means associated therewith. The closure member is retained in the open position by means including a fusible link set to melt at a predetermined temperature. The closure member may also be released manually. Upon the occurrence of a fire, the closure member is released to a closed, magnetically sealed position relative to the frame opening.

5 Claims, 8 Drawing Figures

MAGNETIC SMOKE AND FIRE SHIELD

BACKGROUND OF THE INVENTION

Fire dampers of both the hinge and curtain type are known in the art, some including means for sealing the area between the blade or curtain and the frame to prevent the passage of smoke or fire through a building conduit as evidenced by the prior Jenkins Pat. No. 3,990,464. The Loewenheim U.S. Pat. No. 2,489,915 discloses a hinged-type damper which includes an auxiliary closure element adapted to be moved independently of the damper itself. Curtain dampers including metal sealing strips or loops are disclosed in the patents to Lowe Nos. 2,964,036 and 2,996,063, Beck No. 3,504,883 and Alley No. 3,575,229. The Johnson U.S. Pat. No. 3,165,050 discloses a blade-type damper which includes an axle arrangement for the pivotal blade which co-acts with a slot on the frame to maintain the closed blades tight against the frame. As further disclosed in the Johnson patent, fusible links which melt in the presence of fire or high heat to enable the damper to close are well known in the prior art.

OBJECTS OF THE INVENTION

A primary object of the present invention is to provide an improved damper of the hinged blade or curtain type wherein the blade or curtain is magnetically sealed to the damper frame on all sides to effectively block the passage of smoke or fire through a building conduit or an air register.

Another object of the invention is to provide a smoke and fire shield which may be very simply installed in a building conduit adjacent an air register either during construction of the building or at any time thereafter.

A further object of the invention is the provision of a versatile smoke and fire shield which may be installed directly adjacent the air register of a building and which may utilize the air register itself as a frame for the damper.

An important object of the invention is the provision of a fire and smoke damper which includes a fusible link to allow the damper to close when a predetermined temperature has been reached, but which also includes manual means for closing the damper, thus sealing the conduit and air register when smoke or fire is first detected.

DESCRIPTION OF THE DRAWINGS

These and other objects and advantages of the invention will become apparent from a study of the following specification when viewed in the light of the accompanying drawings, in which.

DETAILED DESCRIPTION

Figure 2A:
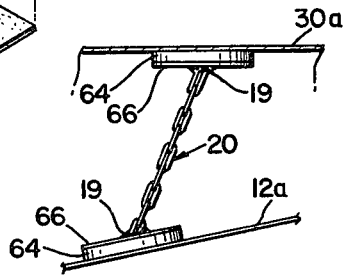
FIG. 2*a* is an exploded cross section of a portion of a building conduit and the door or blade showing the releasable magnetic retaining means of the instant invention.
Figure 2:
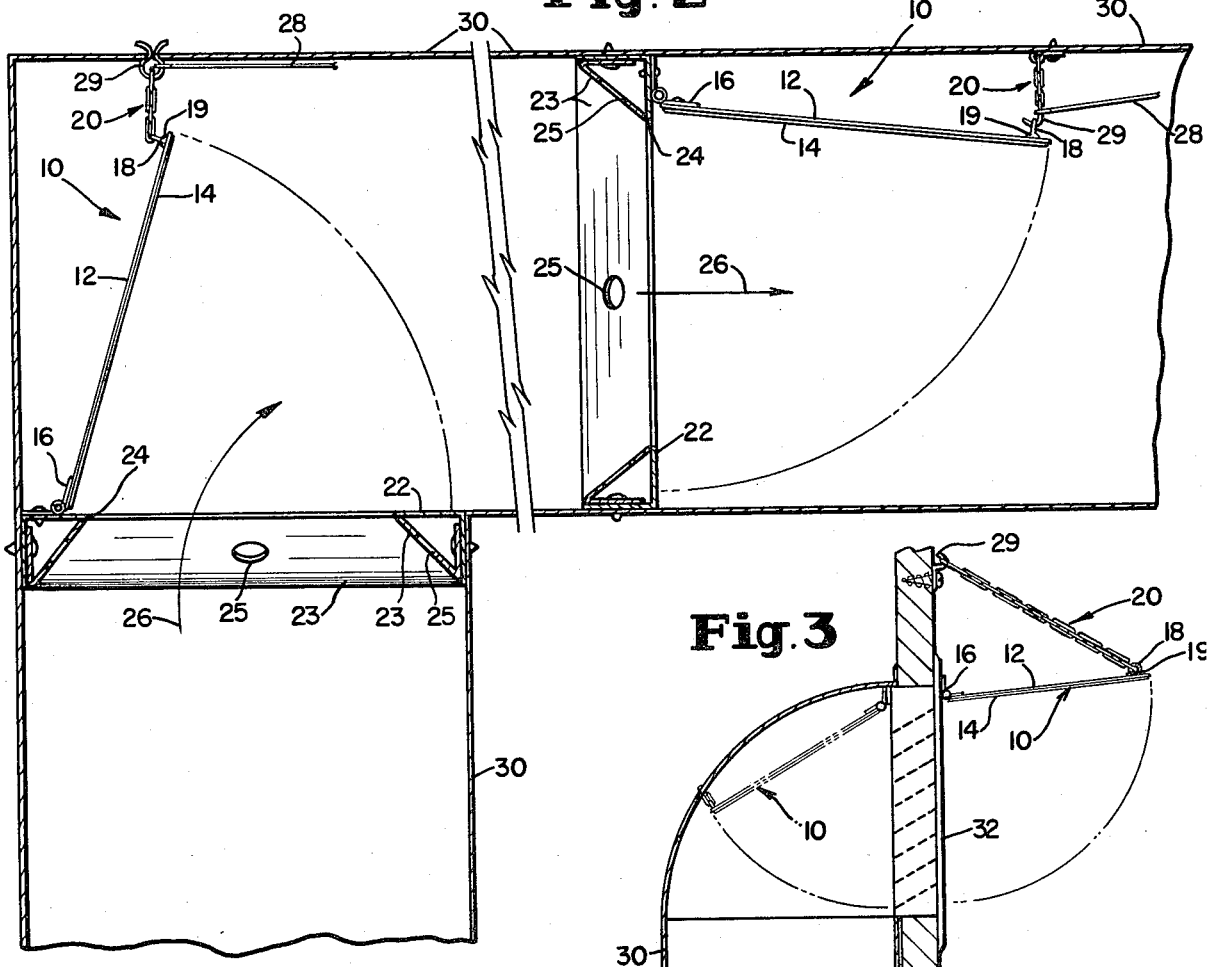
FIG. 2 is a cross section of a building conduit showing the smoke and fire shield installed at a right angle turn in the conduit and in a straight section of the conduit.

As shown in FIG. 2, the smoke and fire shield includes an open rectangular frame or bracket 22 which may be very simply installed in a building conduit adjacent an air register by removing the air register and securing the frame to the duct with a minimum of four sheet metal screws. The frame may include an anti-noise air baffle 23 arranged around all four sides of the frame. Baffle 23 directs air flowing through the duct toward frame opening 24, thus eliminating air turbulence and noise which might result from air striking the edges of the frame. Holes 25 are provided in baffle 23 to permit access to the edges of the frame for installation.

Figure 7:
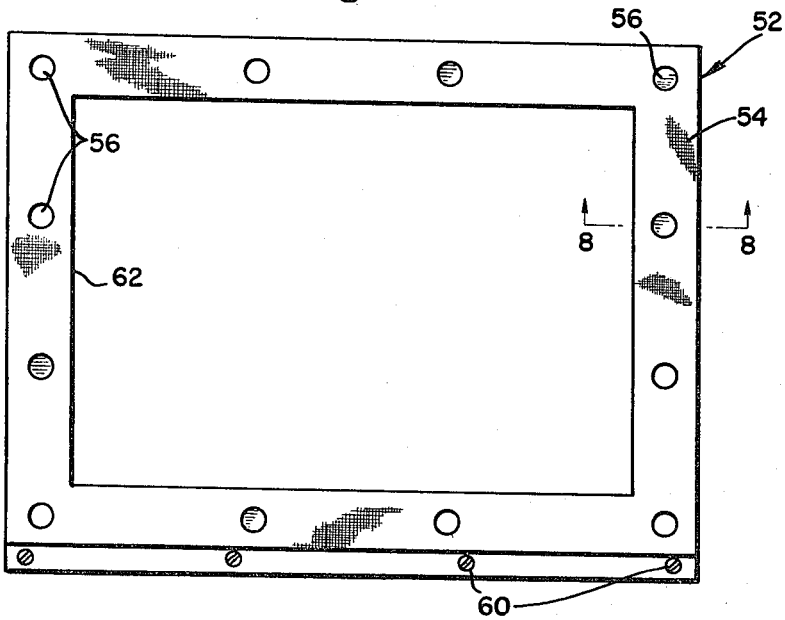
FIG. 7 is a top view of the preferred embodiment of the frame for the smoke and fire shield of FIGS. 1–3.
Figure 8:
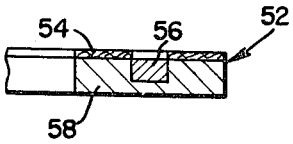
FIG. 8 is a cross section through one edge of the frame of FIG. 7.

Referring now to FIGS. 7 and 8, the preferred embodiment of the frame 52 is formed of a non-magnetic material 58, such as aluminum. A plurality of small magnets 56 are slightly recessed into the upper surface of the frame, and the upper surface and magnets are then covered with air-impervious, heat-resistant cloth 54 such as the cloth manufactured by DuPont and sold under the registered trademark KEVLAR. The cloth 54 covers and smooths out any slight imperfections in the frame, thus assuring a completely air-tight seal between a ferromagnetic door and the frame. In addition, the KEVLAR fibers are heat resistant up to temperatures of about 800° F. The frame defines an opening 62, and mounting screws 60 secure the frame within a building conduit.

Figure 1:
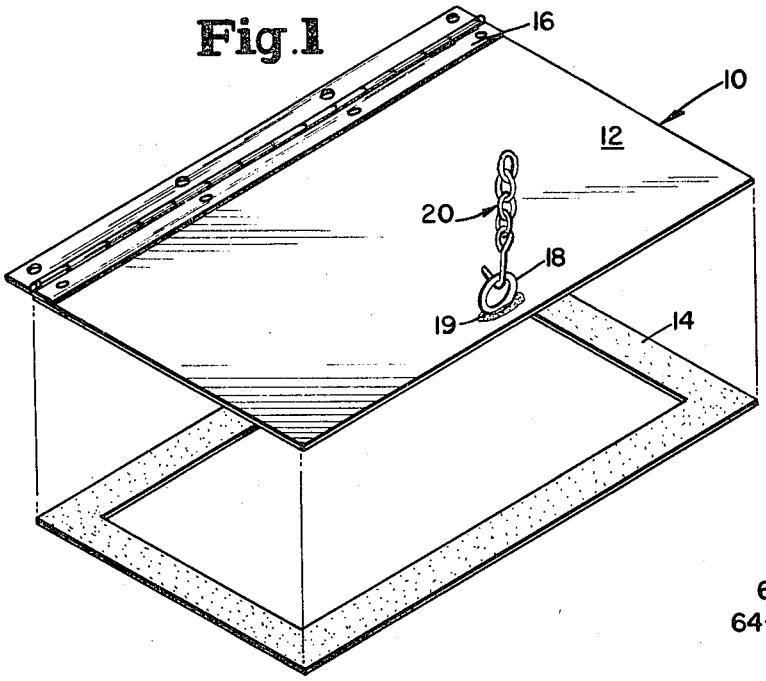
FIG. 1 is a perspective view of a smoke and fire shield blade or door with the peripheral flexible magnet shown separated from the door.

The door or damper blade assembly 10 is shown in FIG. 1. The door assembly includes a door or blade 12 having one portion of a hinge 16 secured to one edge thereof by any well known means such as sheet metal screws. The other portion of hinge 16 hingedly secures the door member to the frame, as shown in FIG. 2. The door assembly further includes means for releasably retaining the door in an open position relative to the frame. The releasable retaining means shown in FIGS. 1 and 2 comprises a short length of chain 20, one end of which is secured to the upper face of the door 12 by means such as a ring 18 and fusible link 19. The other end of the chain may be secured to the top of the duct, thus retaining the door in an open position relative to the frame.

Fusible links are well known in the art, and are usually formed of fusible solder which can be set to melt at a predetermined temperature. The releasable retaining means of the instant invention, in addition to the automatic release provided by the fusible link, includes a manual releasing means. As shown in FIG. 1 and on the right side of FIG. 2, the short length of chain 20 is releasably secured to the door by a hook 29. The other end of the chain is fixedly secured to the top of the duct by means such as a sheet metal screw. On the left of FIG. 2, one end of the chain is fixedly secured to the door, and releasably secured to the top of the duct by a spring clip which may be pushed through a small hole drilled through the duct. In both cases, a manual release means or actuator 28 is secured to releasable connecting means or hook 29. The manual actuator 28 may be a length of any fire and heat resistant material such as chain, wire or fire resistant cloth extending from releasable connecting means 29 through an air register where it is accessible to the occupants of a room. The manual actuator permits the occupant to release the door 12 to seal the conduit at the first sign of smoke or fire prior to automatic release by the fusible link.

Yet another embodiment of the releasable retaining means is shown in FIG. 2*a*. Here the door member 12*a* is retained in its open position by a pair of magnets 64 and connecting chain 20 secured to each magnet by a metal plate 66 and fusible link 19. In use, the magnetic retaining means of this embodiment does not require any screws or any holes in the duct. One of the magnets 64 is simply placed on the ceiling 30*a* of the duct or conduit and the other of the magnets is placed on the door member 12*a*. Both the conduit and the door member must, of course, be formed of ferromagnetic material. While not shown, manual releasing means may be secured to the chain 20, preferably near either end thereof, whereby a pulling force will dislodge one or both of the magnets 64 to release the door member 12*a*.

In accordance with the preferred embodiment of the invention, the door member 12 is formed of ferromagnetic material. Upon release of the retaining means, either manually or automatically, the door member 12 closes and is magnetically sealed to the frame 52 by the plurality of magnets 56.

Alternatively, the frame member may be formed of ferromagnetic material, and the door member may include magnetic sealing means 14 as shown in FIG. 1. Magnetic sealing means 14 comprises a frame-shaped portion of flexible magnetic material adhesively secured to the periphery of door member 12. Thus, as in the previously discussed embodiment, when door member 12 is released, the door member 12 will fall by gravity to meet frame member 22 and will be magnetically sealed to the frame member on all four sides, thus effectively blocking the passage of fire or smoke through the conduit 30.

Figure 3:
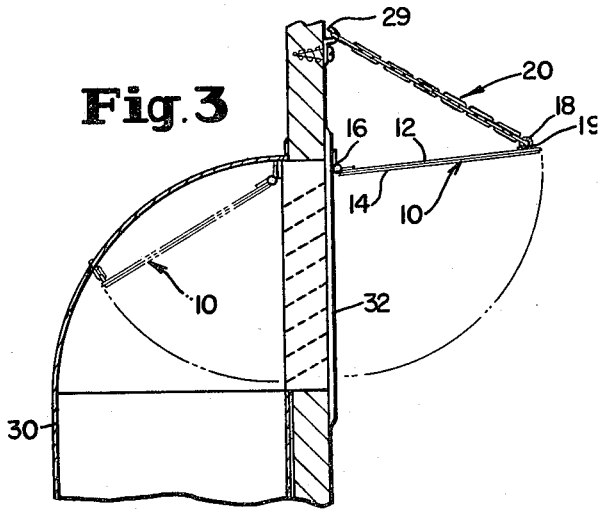
FIG. 3 is a cross section of a building conduit and an air register in the building wall which depicts the smoke and fire shield installed either outside or inside the air register.

FIGS. 2 and 3 illustrate the versatility of installation of the smoke and fire shield of the instant invention. On the left side of FIG. 2, the apparatus is installed at a right angle turn of a conduit 30, while the right side of FIG. 2 illustrates the apparatus installed in a straight section of a conduit 30. In each case, the apparatus is intended for installation adjacent an air register. FIG. 3 shows the door assembly 10, with magnetic sealing means 14 secured thereto, installed directly upon an air register opening. In the embodiment of FIG. 3, the ferromagnetic air register 32 becomes the frame member. Upon automatic or manual release, door member 12 will be magnetically sealed to air register 32 by magnetic sealing means 14.

Figure 4:
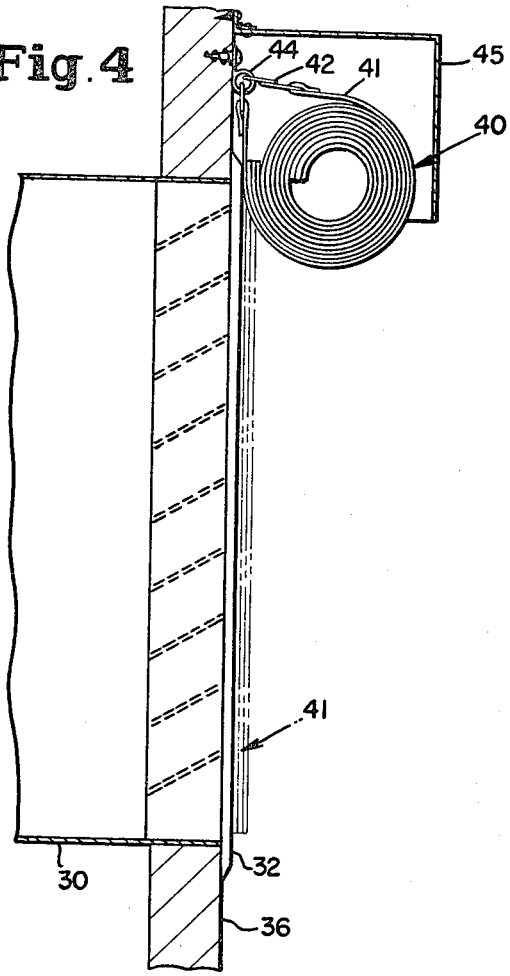
FIG. 4 is a cross section of a building wall and an air register showing a second embodiment of the magnetic smoke and fire shield of the instant invention.
Figure 5:
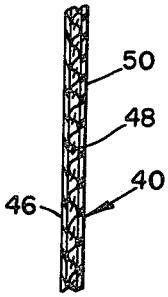
FIG. 5 is a cross section through one edge of the flexible smoke and fire shield of FIG. 4.
Figure 6:
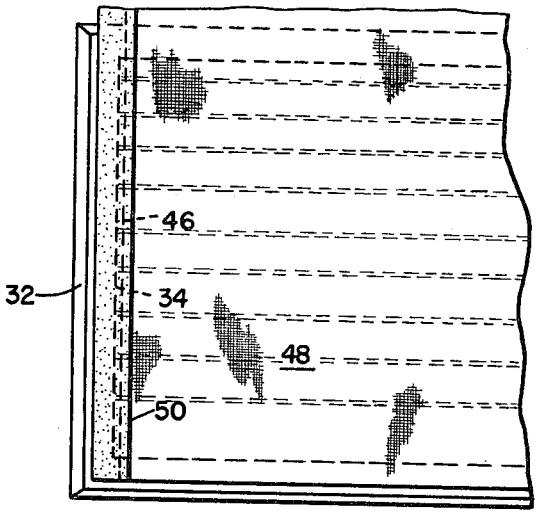
FIG. 6 is a fragmentary elevation of the flexible smoke and fire shield of FIG. 4 as it covers a register upon release.

Referring now to FIGS. 4–6, yet another embodiment of the invention is illustrated in the form of a flexible or curtain-type smoke and fire shield. Flexible closure member or curtain 40, shown in its open or rolled-up position in FIG. 4, is installed directly adjacent air register 32 in building wall 36 leading from conduit 30. As shown in FIG. 5, curtain 40 comprises a sheet of heat-resistant cloth 48, such as KEVLAR by DuPont previously discussed, of the same size as air register 32. Magnetic sealing means 46 is secured to the under or air register side of curtain 40, forming a frame around all four sides of the curtain. The sealing means may comprise flexible magnetic material adhesively secured to curtain 40. Because magnetic sealing means 46 would adhere to itself when curtain 40 was in the open or rolled position, rubber insulating strip 50 is secured to the upper or room side of curtain 40 around all four sides. Rubber strip 50 prevents the magnetic sealing means from adhering to itself, so that the curtain, when released, will drop easily to cover the air register.

As shown in FIG. 4, the releasable retaining means for closure member 40 comprises strap member 41 including a hook at each end. A first end of strap 41 is secured to the top of curtain 40 on the under or air register side thereof so that curtain 40 is suspended from hangar 44 arranged in building wall 36. Strap 41 surrounds curtain 40 in its open position and releasable retaining means are arranged at the second end thereof in the form of the second hook member and fusible link 42. Fusible link 42 forms a bridge between hangar 44 and the second hook member and, as in the previous embodiments, is set to melt at a predetermined temperature to release curtain 40 to its closed, sealed position. The second hook member comprises a manual releasing means.

As a practical matter, if the closure member 40 is very wide, two straps 41 may be used to co-act with two hangar members 44, one on each side of the closure member. An optional hinged cover 45 may be installed over curtain 40 for decorative purposes. Cover 45 comprises an L-shaped structure preferably formed of a metallic material such as aluminum or sheet metal, and may be closed at each end. Cover 45 is hingedly installed so that it may be pivoted away from the closure member 40 for access to the manual release hook.

FIG. 6 illustrates a portion of air register 32 with a portion of closure member 46 in its closed or unrolled condition covering air register opening 34 and magnetically sealed to the ferromagnetic frame of air register 32.

While, in accordance with the Patent Statutes, the preferred embodiments of the invention have been illustrated and described, it will be apparent to those skilled in the art that changes may be made without deviating from the inventive concepts set forth above.

What is claimed is:

1. A magnetic smoke and fire shield for controlling the flow of fluid through a conduit, comprising (a) a frame member adapted for mounting across said conduit, said frame member containing an opening;

(b) a closure member connected with said frame member for movement between open and close positions relative to said frame opening, at least one of same frame and closure members being at least partially formed of a ferromagnetic material;

(c) releasable retaining means including a fusible link and a hook member connected with said fusible link for maintaining said closure member in the open position relative to said frame member, said fusible link being meltable at a predetermined temperature to automatically move said closure member to the closed position, and said hook member being manually releasable from said fusible link to manually move said closure member to the closed position;

(d) manual release actuating means including a length of fire and heat resistance material for manually releasing said hook member from said fusible link; and (e) magnetic sealing means mounted on the other of said frame and closure members operable upon release of said retaining means for maintaining said closure member in a closed sealed position relative to said frame opening.

2. The magnetic smoke and fire shield of claim 1, wherein said frame member comprises an open rectangular bracket adapted for mounting within the conduit of a building, said frame being formed of non-magnetic material; wherein said closure member comprises a door member hingedly connected with said frame; and further wherein said magnetic sealing means comprises a plurality of magnets recessed in said frame member.

3. The magnetic smoke and fire shield of claim 1, wherein said frame member comprises an open rectangular bracket adapted for mounting within the conduit of a building, said frame member being formed of ferromagnetic material, and said closure member comprises a door member hingedly connected with said frame member, and further wherein said magnetic sealing means comprises flexible magnetic material secured to said door member in facing relationship to said frame member.

4. The magnetic smoke and fire shield of claim 2 or claim 3, wherein said frame member further includes anti-noise air baffle means.

5. Apparatus as defined in claim 2, and further including a layer of heat-resistant air-impervious cloth mounted on one of the adjacent surfaces of said frame and closure members.

* * * * *